US007357269B2

(12) United States Patent
Apps

(10) Patent No.: US 7,357,269 B2
(45) Date of Patent: Apr. 15, 2008

(54) CONTAINER

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 14 days.

(21) Appl. No.: 11/264,681

(22) Filed: Nov. 1, 2005

(65) Prior Publication Data

US 2007/0095692 A1 May 3, 2007

(51) Int. Cl.
*B65D 6/00* (2006.01)

(52) U.S. Cl. ..... 220/6; 220/7; 220/4.28

(58) Field of Classification Search ..... 206/509, 206/600; 220/4.28, 6, 7
See application file for complete search history.

(56) References Cited

U.S. PATENT DOCUMENTS

| | | | | |
|---|---|---|---|---|
| 1,689,217 | A | | 10/1928 | White |
| 2,134,875 | A | | 11/1938 | Henze |
| 3,220,603 | A | | 11/1965 | Bromley |
| 3,446,415 | A | * | 5/1969 | Bromley ..... 220/7 |
| 3,874,546 | A | | 4/1975 | Sanders et al. |
| 3,951,265 | A | | 4/1976 | Carroll |
| 4,106,623 | A | | 8/1978 | Carroll |
| 4,109,791 | A | | 8/1978 | Clipson et al. |
| 4,241,831 | A | | 12/1980 | Locatelli |
| 4,247,004 | A | | 1/1981 | Bird |
| 4,391,369 | A | | 7/1983 | Stahl et al. |
| 4,423,813 | A | | 1/1984 | Kreeger et al. |
| 4,466,541 | A | | 8/1984 | Tabler et al. |
| 4,573,577 | A | | 3/1986 | Miller |
| RE32,223 | E | | 8/1986 | Kreeger et al. |
| 4,643,310 | A | | 2/1987 | Deaton |
| 4,759,451 | A | | 7/1988 | Apps |
| 4,848,578 | A | | 7/1989 | Schafer |
| 4,863,062 | A | | 9/1989 | Holliday |
| 4,901,859 | A | | 2/1990 | Jones |
| 4,905,833 | A | | 3/1990 | Kreeger et al. |
| 4,947,992 | A | | 8/1990 | Schafer |
| 5,083,666 | A | | 1/1992 | Lam |
| 5,494,163 | A | | 2/1996 | Apps |

(Continued)

FOREIGN PATENT DOCUMENTS

| | | |
|---|---|---|
| DE | 1536040 | 12/1969 |

(Continued)

OTHER PUBLICATIONS

United Kingdom Search Report, dated Jan. 17, 2007.

(Continued)

*Primary Examiner*—Luan K Bui
(74) *Attorney, Agent, or Firm*—Carlson, Gaskey & Olds PC

(57) ABSTRACT

A collapsible container includes a plurality of walls collapsible onto the base. At least one wall has a support pivotably and slidably mounted to an upper end portion thereof. The support is pivotable between a support position where it is partially supported on an adjacent wall and a retracted position. In the retracted position, the wall can be pivoted downward onto the base, with a portion of the support passing through a channel formed on the interior of the adjacent wall. As the wall is pivoted to the upright position, the support is automatically deployed into the support position by its engagement with the channel.

15 Claims, 11 Drawing Sheets

U.S. PATENT DOCUMENTS

| | | | | |
|---|---|---|---|---|
| 5,609,254 | A | 3/1997 | Loftus | |
| D381,203 | S | 7/1997 | Ackermann | |
| 5,772,033 | A | 6/1998 | Loftus | |
| 5,924,572 | A * | 7/1999 | Cope | 206/518 |
| 5,975,324 | A | 11/1999 | Schmitt | |
| 6,015,056 | A | 1/2000 | Overholt et al. | |
| 6,056,177 | A * | 5/2000 | Schneider | 220/6 |
| 6,059,114 | A | 5/2000 | Loftus | |
| 6,082,570 | A | 7/2000 | Tai | |
| 6,142,329 | A | 11/2000 | Dotan | |
| 6,179,156 | B1 | 1/2001 | Aiken | |
| 6,286,701 | B1 | 9/2001 | Umiker | |
| 6,290,081 | B1 | 9/2001 | Merey | |
| 6,382,458 | B2 | 5/2002 | Mori | |
| 6,409,041 | B1 | 6/2002 | Overholt et al. | |
| 6,581,330 | B1 | 6/2003 | Helsloot et al. | |
| 6,994,216 | B2 | 2/2006 | Wong | |
| 2003/0222081 | A1* | 12/2003 | Apps et al. | 220/7 |
| 2005/0040166 | A1* | 2/2005 | Nolet et al. | 220/6 |

FOREIGN PATENT DOCUMENTS

| | | |
|---|---|---|
| DE | 35 11 321 | 10/1986 |
| DE | 3511321 | 10/1986 |
| DE | 35 21 894 | 1/1987 |
| DE | 3521894 | 1/1987 |
| DE | 199 39 019 A1 | 8/1999 |
| DE | 19939019 | 8/1999 |
| DE | 200 02 537 | 2/2000 |
| DE | 20002537 | 2/2000 |
| EP | 0 073 357 | 3/1983 |
| EP | 0073357 | 3/1983 |
| EP | 0 299 657 | 7/1988 |
| EP | 0299657 | 7/1988 |
| EP | 0 341 074 | 5/1989 |
| EP | 0341074 | 5/1989 |
| EP | 0 385 914 | 9/1990 |
| EP | 0385914 | 9/1990 |
| EP | 0 404 041 | 12/1990 |
| EP | 0404041 | 12/1990 |
| EP | 0 785 142 | 7/1997 |
| EP | 0785142 | 7/1997 |
| EP | 0 962 396 | 5/1999 |
| EP | 0962396 | 12/1999 |
| EP | 1 114 779 | 7/2001 |
| EP | 1114779 | 7/2001 |
| EP | 1 241 105 | 9/2002 |
| FR | 9302492 | 3/1993 |
| FR | 2702198 | 9/1994 |
| GB | 2068338 | 8/1981 |
| GB | 2 129 401 | 5/1984 |
| GB | 2129401 | 5/1984 |
| GB | 2 141 778 | 1/1985 |
| GB | 2141778 | 1/1985 |
| GB | 2 171 980 | 9/1986 |
| GB | 2171980 | 9/1986 |
| GB | 2431921 | 5/2007 |
| GB | 2431922 | 5/2007 |
| NL | 790 5105 | 6/1979 |
| NL | 7905105 | 6/1979 |
| WO | 93/24378 | 12/1993 |
| WO | 9749613 | 12/1997 |
| WO | WO 97 49613 | 12/1997 |
| WO | 98/56668 | 12/1998 |
| WO | 00/27716 | 5/2000 |
| WO | WO 00/27716 | 5/2000 |
| WO | 00/66440 | 11/2000 |
| WO | WO 00/66440 | 11/2000 |
| WO | 03/104094 | 12/2003 |
| WO | WO 03/104094 | 12/2003 |

OTHER PUBLICATIONS

United Kingdom Search Report, Feb. 8, 2007.

* cited by examiner

CONTAINER

BACKGROUND OF THE INVENTION

The present invention relates generally to collapsible crates and more particularly to a collapsible crate with support members for supporting another container thereon.

Collapsible crates are well known. Four walls each connected via a hinge to a base are selectively movable about the hinge between a use position, in which the wall is generally perpendicular to the base, and a collapsed position onto the base. Various mechanisms have been provided to connect adjacent walls at the corner to selectively lock the crate in the use position.

SUMMARY OF THE INVENTION

The present invention provides a collapsible container having a plurality of walls collapsible onto the base. At least one wall has a support pivotably and slidably mounted to an upper end portion thereof. The support is pivotable between a support position where it is partially supported on an adjacent wall and a retracted position. In the retracted position, the wall can be pivoted downward onto the base to its collapsed position, with a portion of the support passing through a channel formed on the interior of the adjacent wall.

When the wall is pivoted from the collapsed position to its upright position, the portion of the support engages the channel on the interior of the adjacent wall. As the wall is pivoted upwardly, the channel causes the support to move from the retracted position toward the support position automatically.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
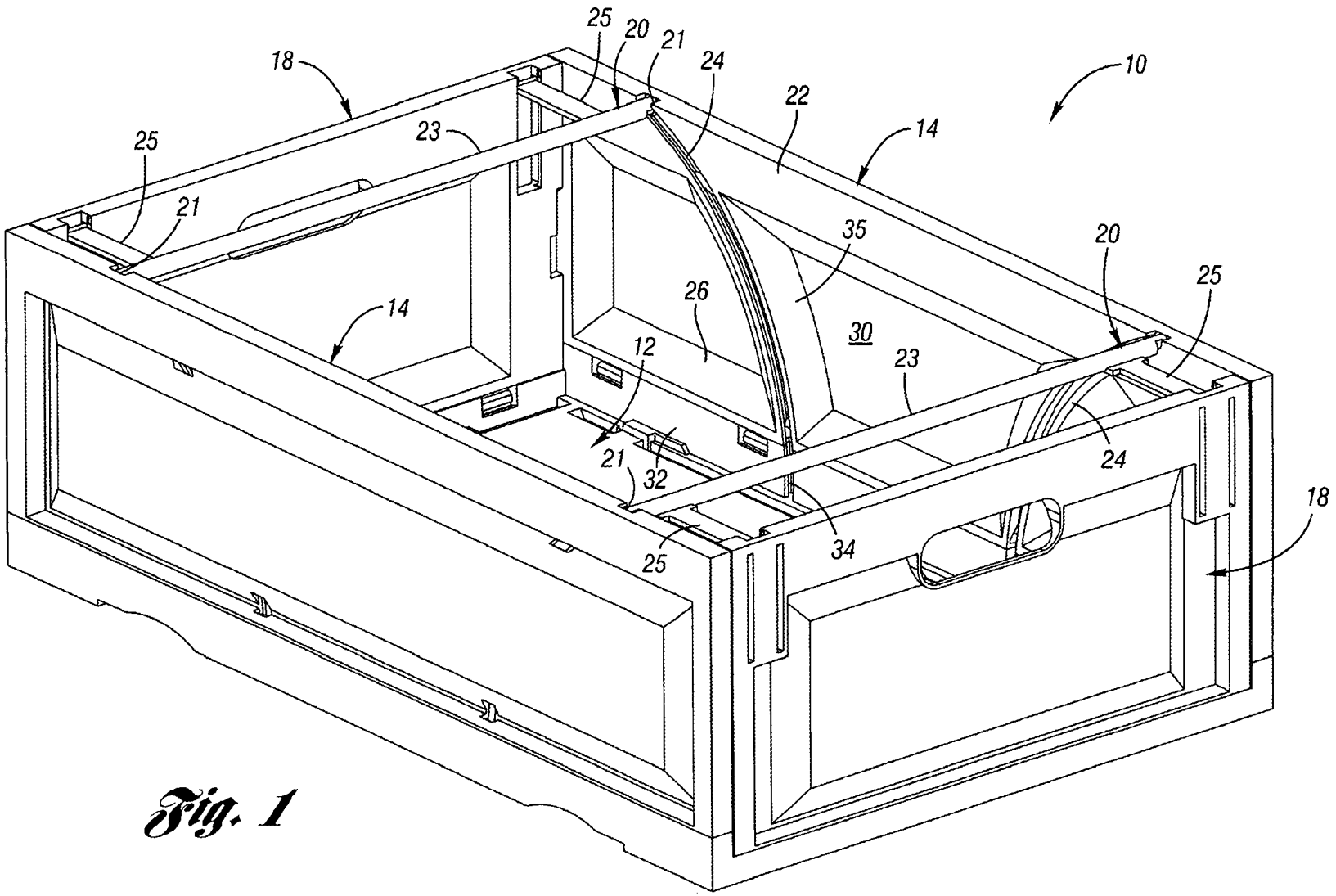
FIG. 1 is a perspective view of a container according to the present invention, with the walls in the upright position and the supports in the support position.

FIG. 1 illustrates a container 10 according to the present invention. The container 10 includes a base 12 having upstanding side walls 14 (or long walls) and upstanding end walls 18 (or short walls). The side walls 14 and end walls 18 are pivotably connected along long and short edges of the base 12, respectively. The side walls 14 and end walls 18 are movable between the upright position shown and a collapsed position on the base 12.

Each end wall 18 has a support 20 pivotably and slidably mounted to an upper portion thereof. The supports 20 are shown in FIG. 1 pivoted to a support position generally perpendicular to the end walls 18 and projecting into the interior of the container 10. Each support 20 includes an elongated rail 23 (or support portion) and a pair of arms 25 extending perpendicularly from the rail 23. In the support position, laterally-extending ends 21 of the rail 23 are supported on the side walls 14.

The interiors of the side walls 14 each include an upper frame portion 22 and a lower frame portion 26 protruding into the container 10. A recess 30 is defined between the upper frame portion 22 and the lower frame portion 26. A curved frame portion 35 extends in a curved path from the upper frame portion 22 to the lower frame portion 26. A curved channel 24 opens at an upper edge of the side wall 14 and is defined through the upper frame portion 22, curved frame portion 35 and the lower frame portion 26.

The base 12 includes a pair of side upstanding portions 32 to which the side walls 14 are pivotably attached. Each side upstanding portion 32 includes a pair of channels 34 formed on an interior thereof. When the side walls 14 are upright, the channels 24 are aligned with the channels 34. The base 12 further includes a pair of end upstanding portions 36 to which the end walls 18 are pivotably attached.

Figure 2:
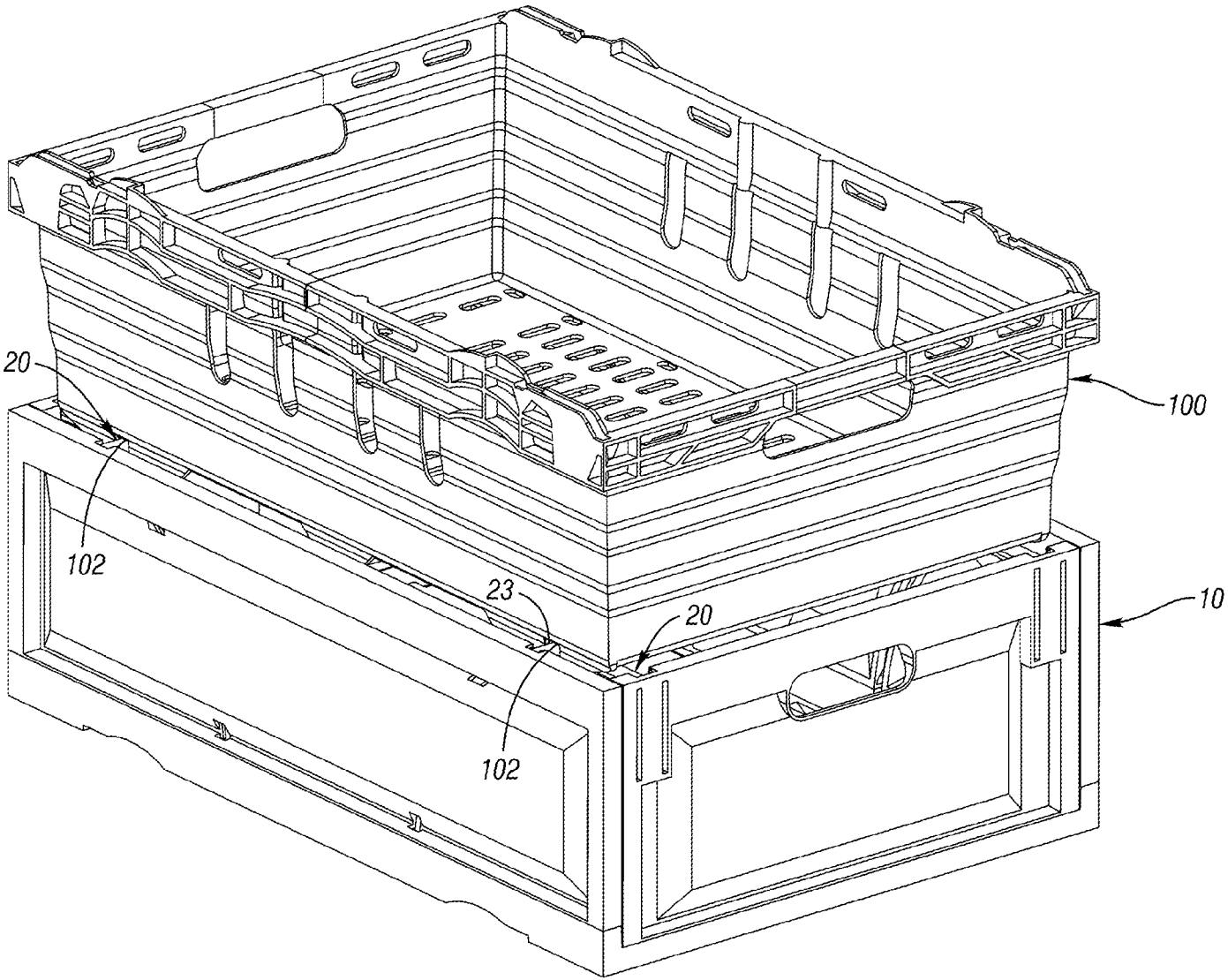
FIG. 2 illustrates the container of FIG. 1 with a second container supported thereon.

FIG. 2 illustrates the container of FIG. 1 with a second container 100 supported thereon. The second container 100 includes a pair of recesses 102 into which are received the rails 23 of the supports 20.

Figure 3:
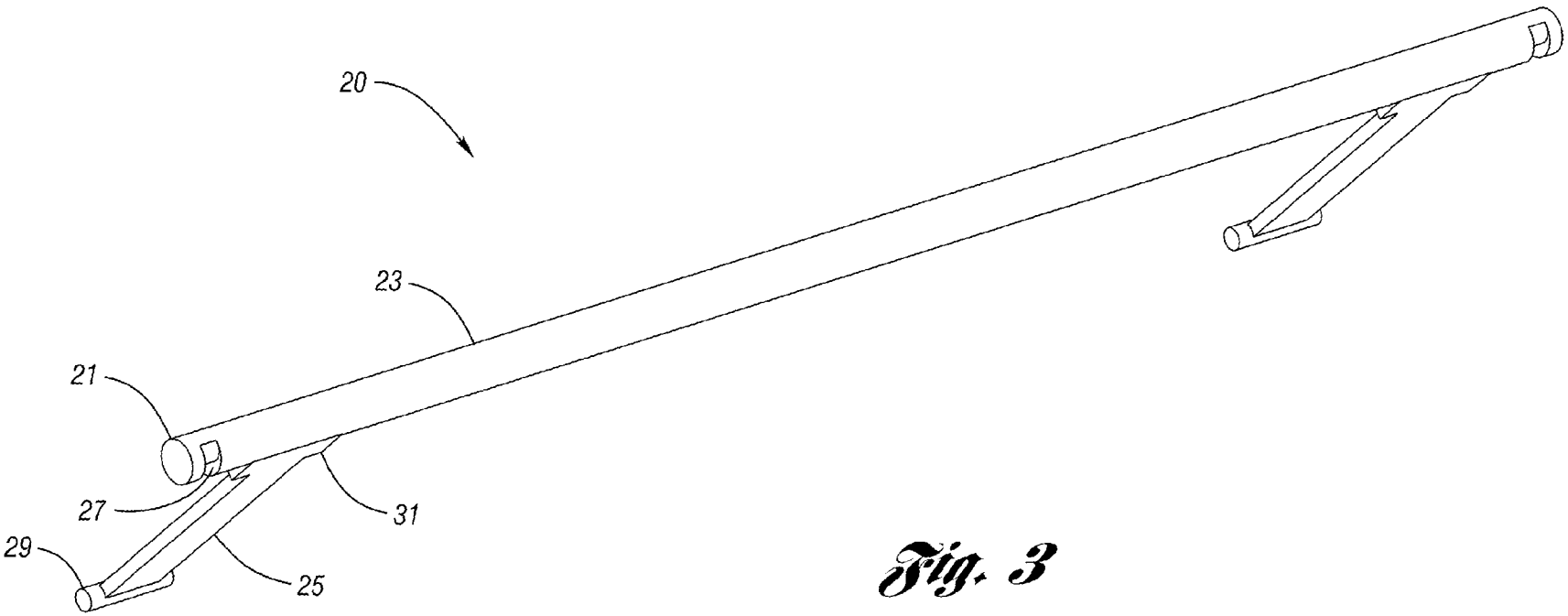
FIG. 3 is a perspective view of one of the supports of FIG. 1.

FIG. 3 is a perspective view of one of the supports 20 of FIG. 1. Each support 20 includes the elongated rail 23 and the pair of arms 25 extending perpendicularly from the rail 23. A slot 27 is formed on the underside of the rail 23 adjacent each end 21. Each of the arms 25 includes an integral pivot pin 29 at an end of the arm 25 opposite the rail 23. Each of the arms 25 includes a shoulder 31 spaced away from the rail 23.

Figure 4:
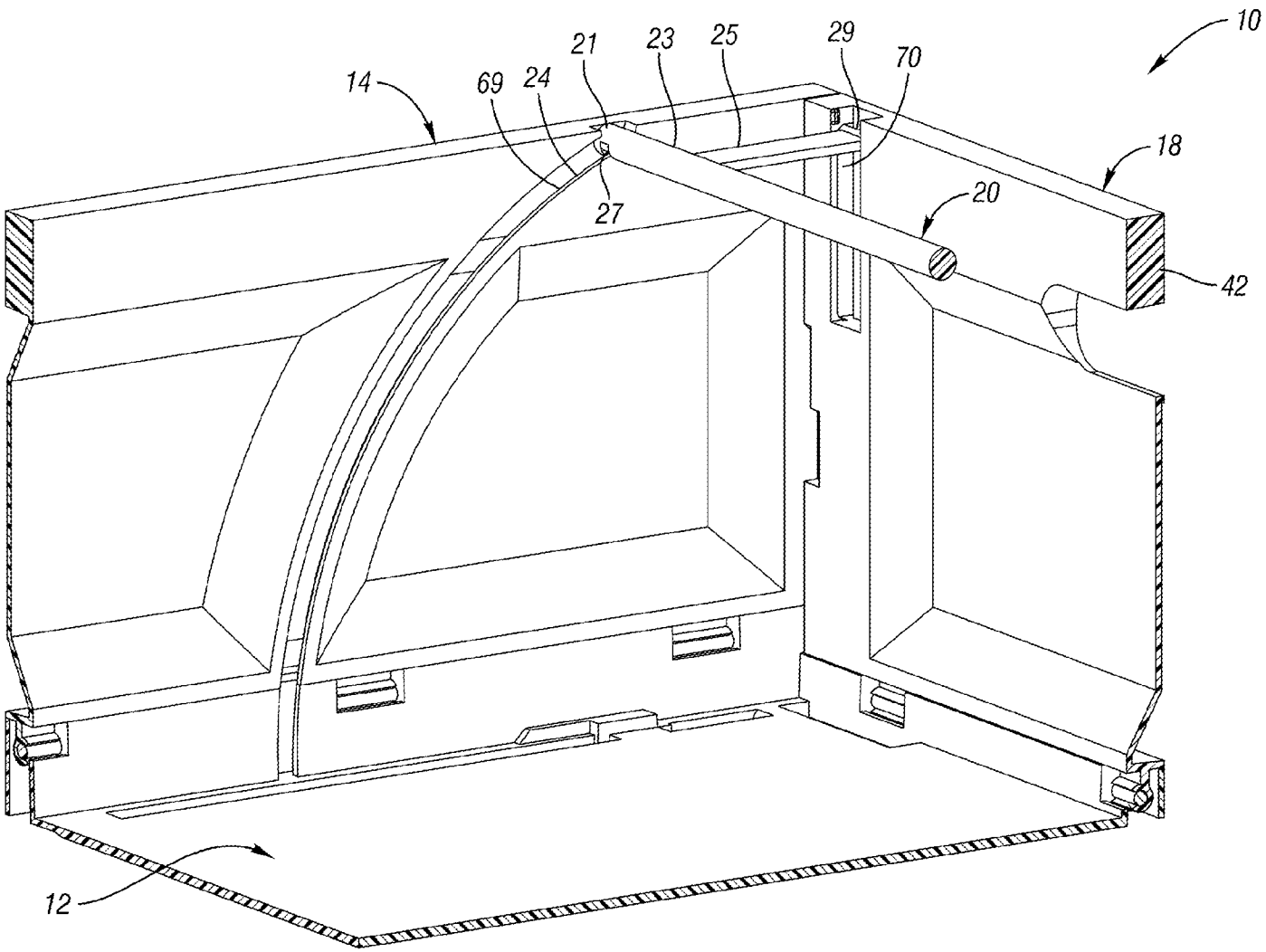
FIG. 4 is an interior perspective view, partially broken away, of the container of FIG. 1.

FIG. 4 is an interior perspective view, partially broken away, of the container 10 of FIG. 1. As shown, the end 21 of the support 20 is received at an upper end of in the channel 24 when the support 20 is in the support position. The slot 27 in the end 21 of the support 20 receives a wall 69 adjacent the channel 24. The pivot pin 29 is pivotably and slidably connected to a channel 70 in the end wall 18. The end wall 18 includes a handle 42 formed therein.

Figure 5:
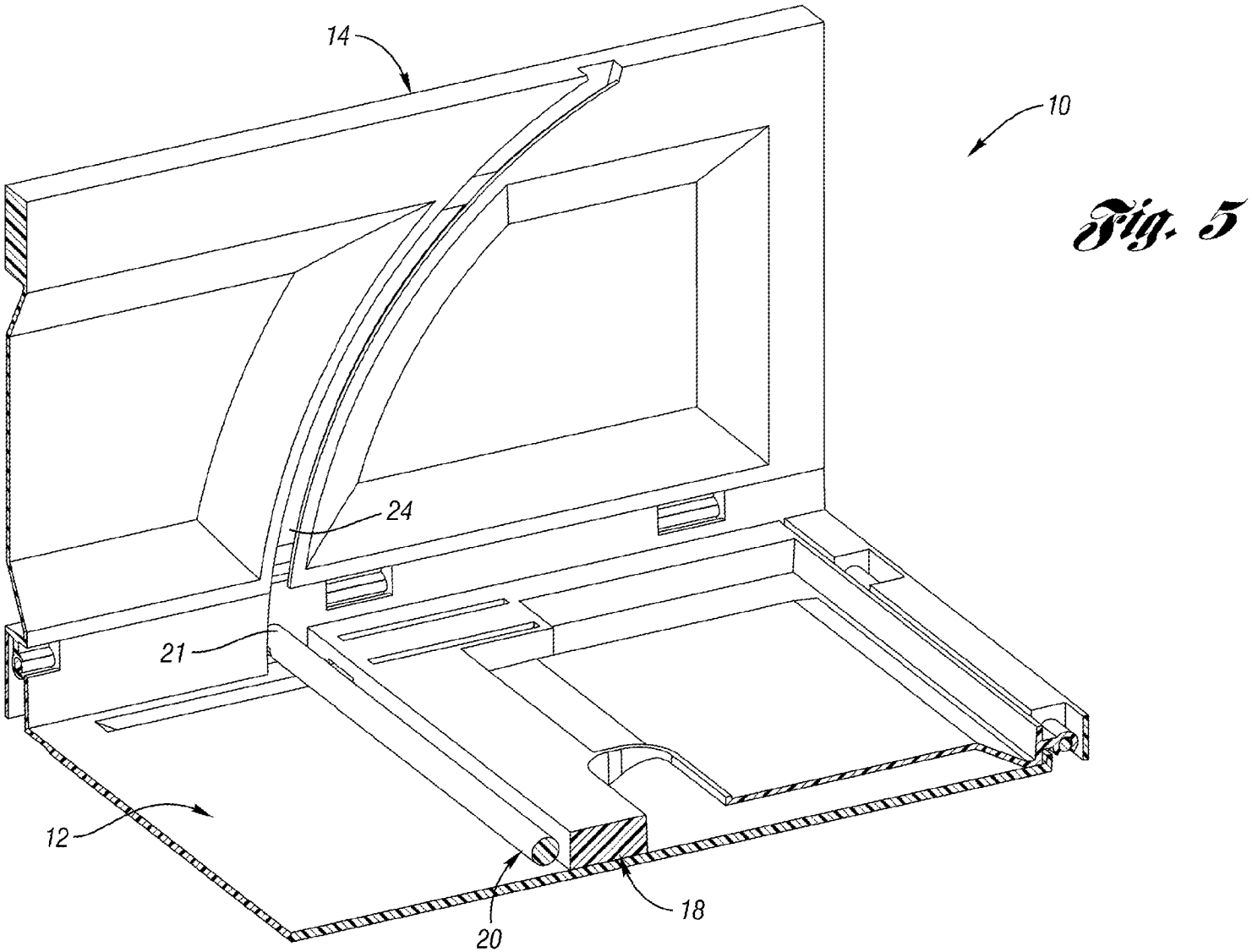
FIG. 5 is a view similar to that of FIG. 4, with the wall in the collapsed position.
Figure 6:
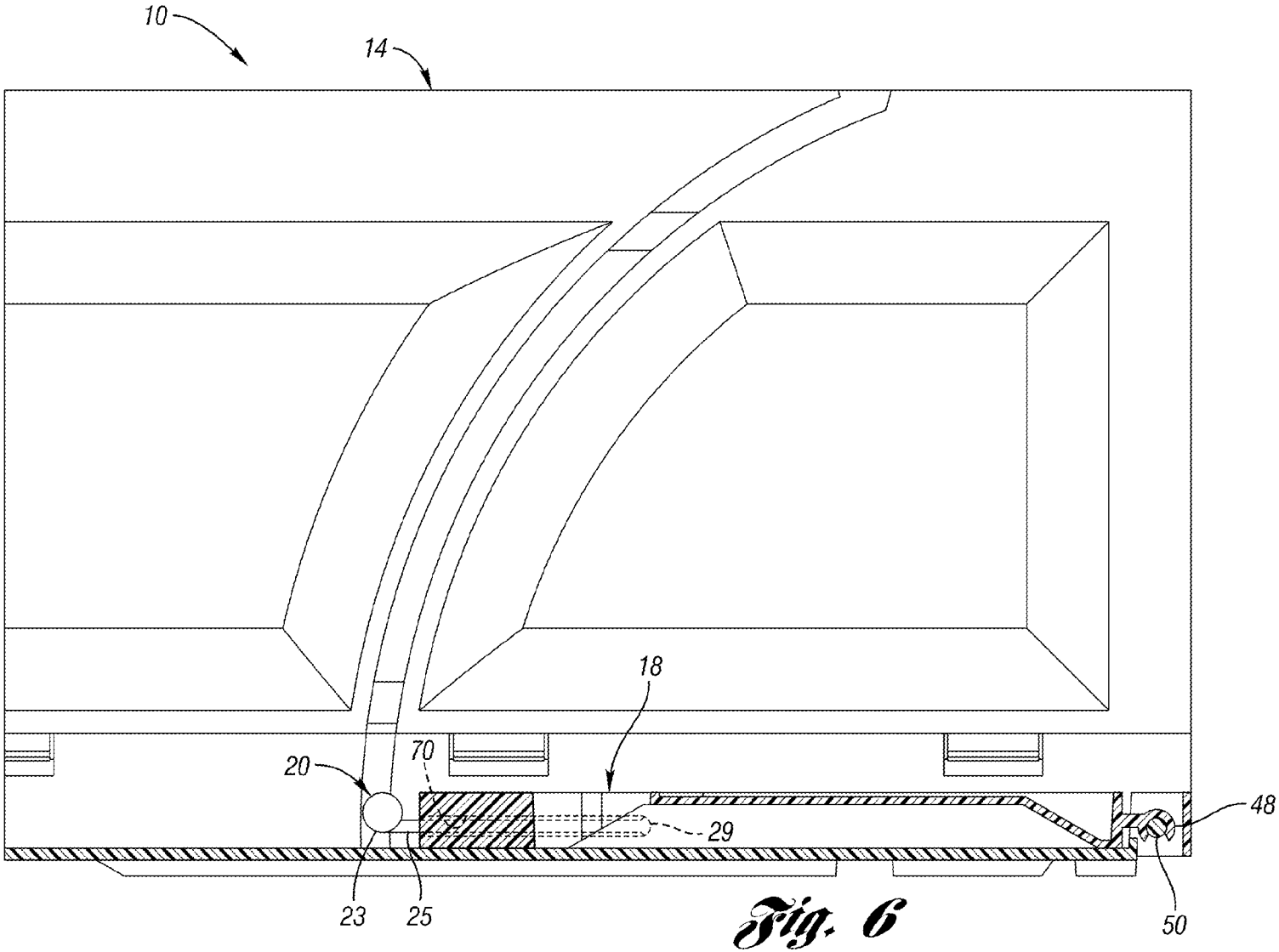
FIG. 6 is a sectional view taken along the break line of FIG. 5.

FIG. 5 illustrates the container 10 with the end wall 18 in the collapsed position. The end wall 18 and support 20 (which is partially retracted into the end wall 18) lie flat on the base 12. The end 21 of the support 20 is aligned with the channel 24 in the side wall 14. As shown in FIG. 6, in this position, the arms 25 of the support 20 are mostly retracted into the channels 70 in the end wall 18. The end wall 18 is pivotable about a hinge including a hinge member 48 integrally molded with the end wall 18 and a hinge pin 50 integrally molded with the base 12.

Figure 7:
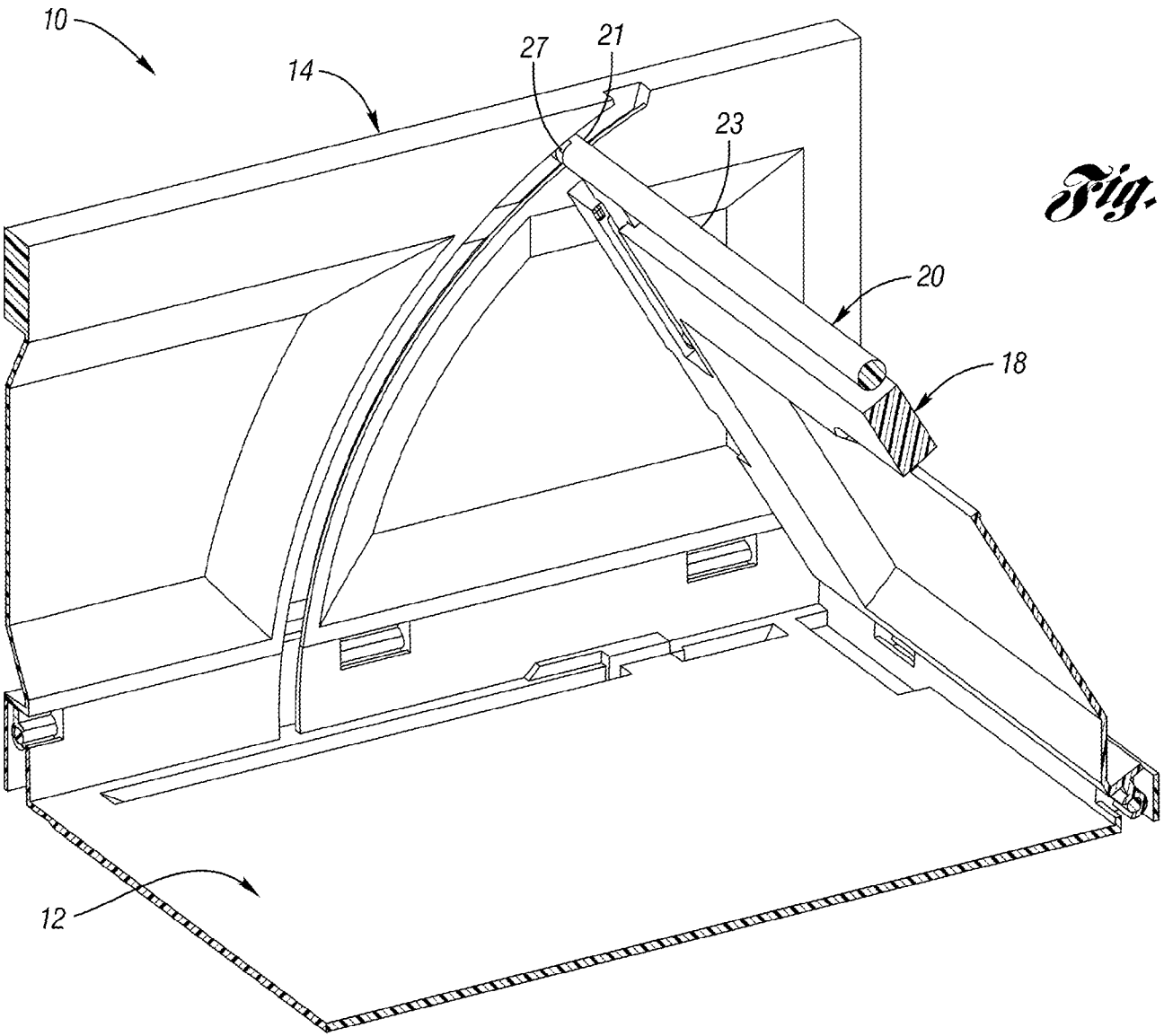
FIG. 7 is a view similar to that of FIG. 5, with the wall being pivoted toward the upright position.
Figure 8:
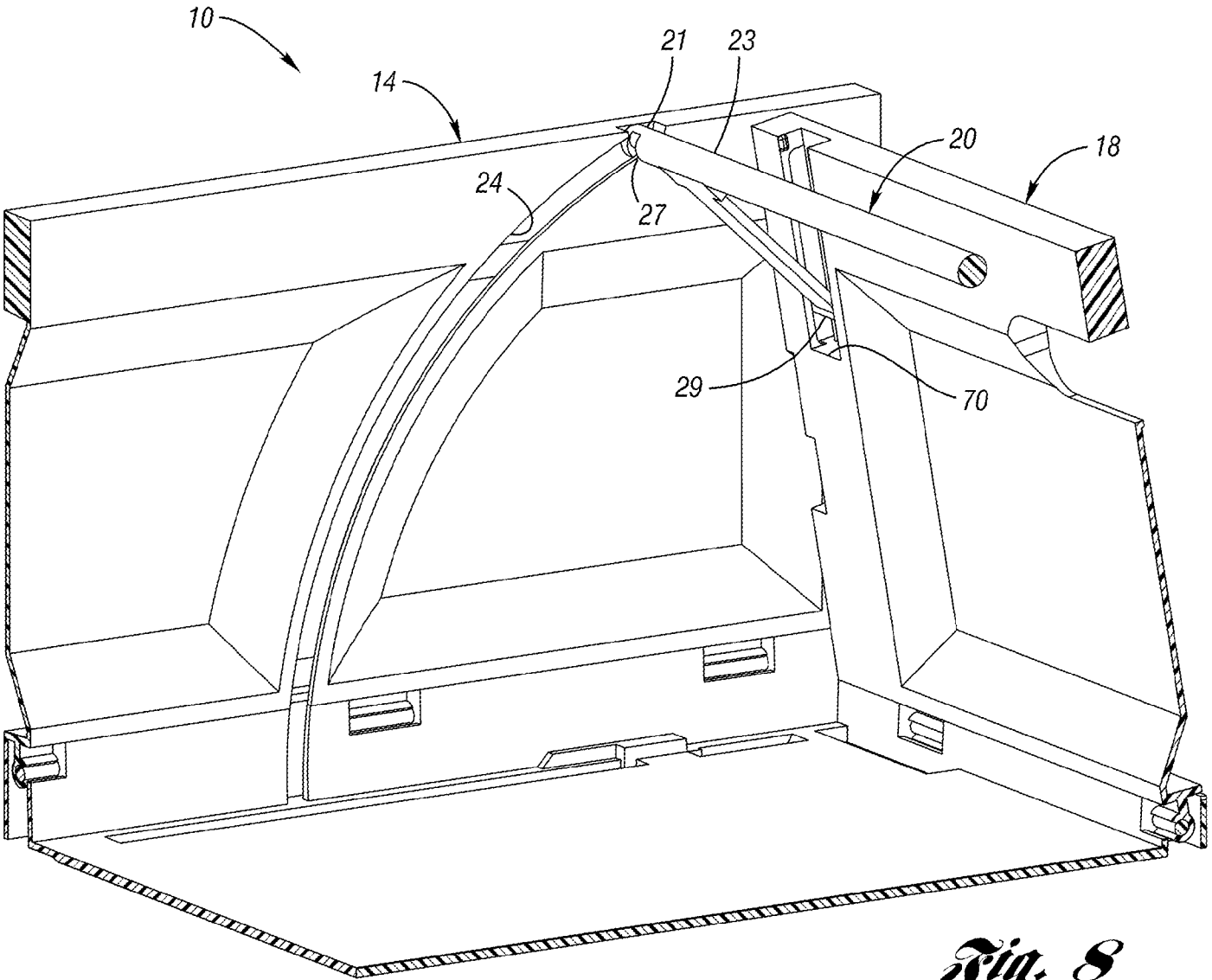
FIG. 8 is a view similar to that of FIG. 7, with the wall being pivoted further toward the upright position and the support beginning to deploy from the wall.

FIG. 7 is a view similar to that of FIG. 5, with the end wall 18 being pivoted toward the upright position. The end 21 of the rail 23 is captured in the channel 24, with the slot 27 beginning to engage a wall adjacent the channel 24. When the support 20 reaches the end of the channel 24 as shown in FIG. 8, the rail 23 ceases moving with the end wall 18. The rail 23 remains at the top of the channel 24 as the end wall 18 is pivoted to the upright position. This final movement (and/or manual movement of the arms 25) causes the hinge pin 29 to slide upwardly in the channel 70 of the end wall 18, until the hinge pin 29 snaps into place at the top of the channel 70 in the position shown in FIG. 4. Simultaneous rotation of the support 20 causes the slot 27 to fully engage the wall adjacent the channel 24, thereby improving the amount of load that the rail 23 can support.

Figure 9:
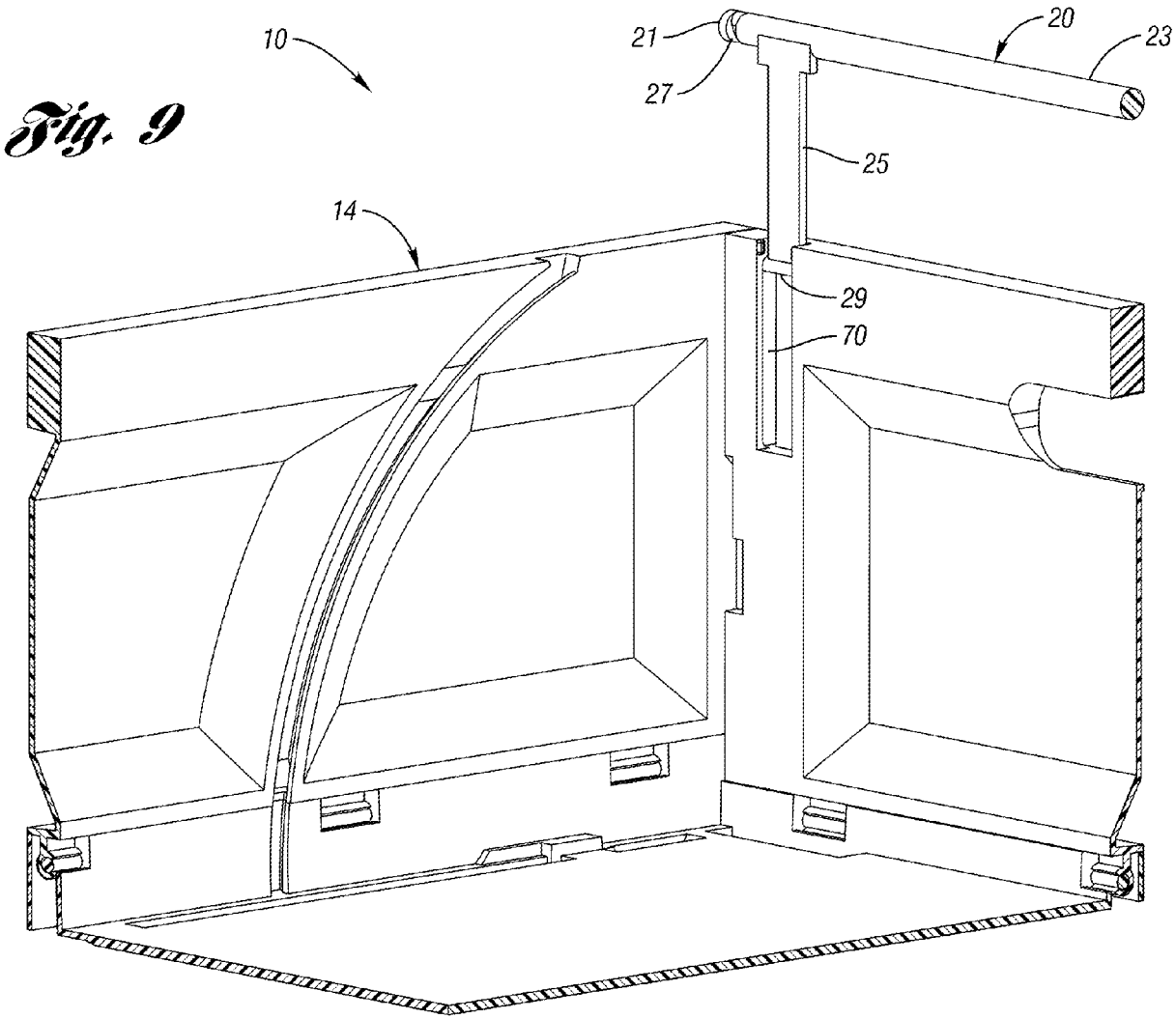
FIG. 9 is a view similar to that FIG. 8 with the support in the vertical position.

To collapse the end wall 18 again, the support 20 is first pivoted to the vertical position as shown in FIG. 9. In this position, the hinge pin 29 of the support 20 is at the top of the channel 70 in the end wall 18 and the rail 23 is spaced high above the upper edge of the end wall 18.

Figure 10:
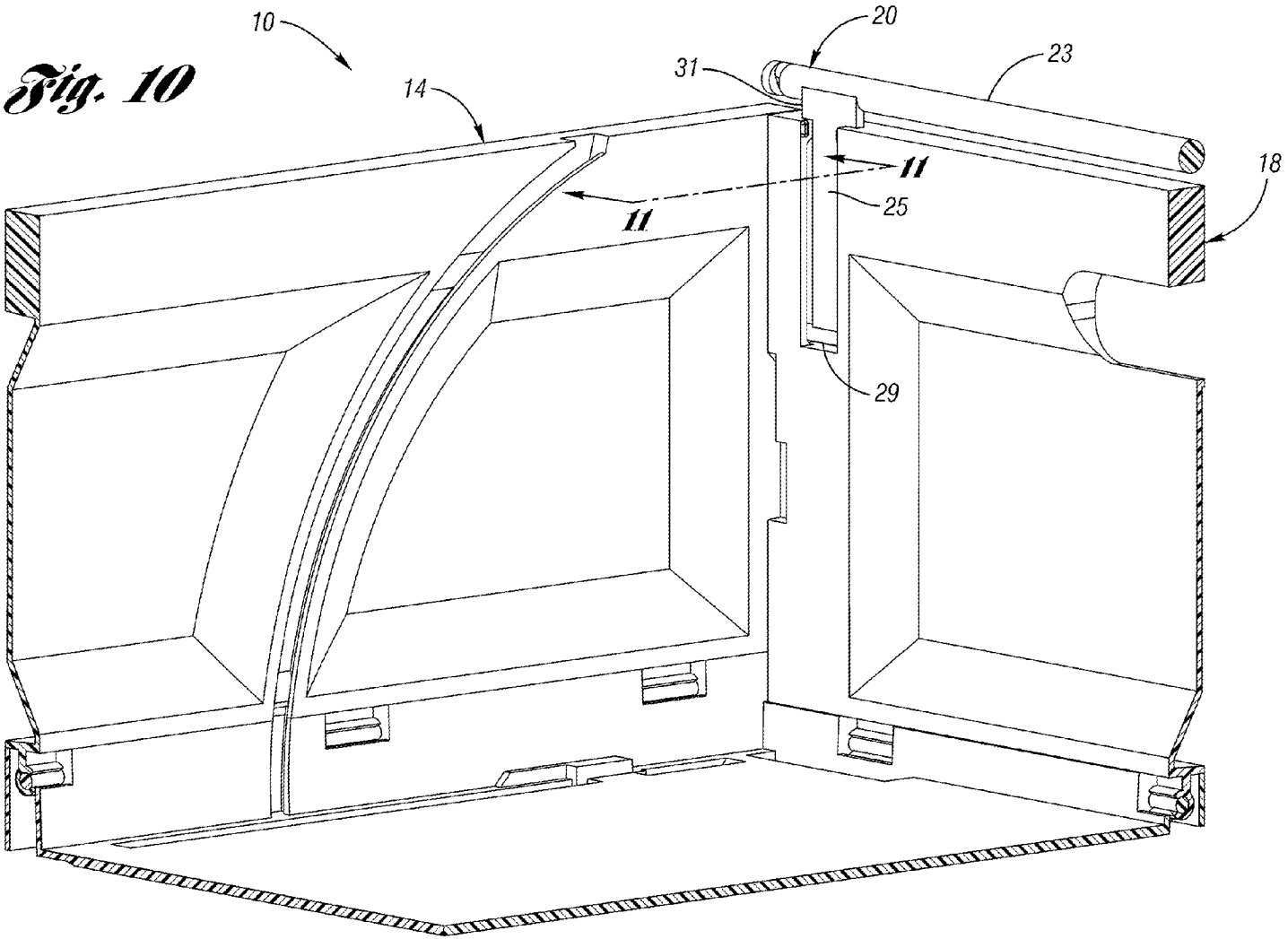
FIG. 10 is a view similar to that FIG. 9 with the support retracted into the wall.
Figure 11:
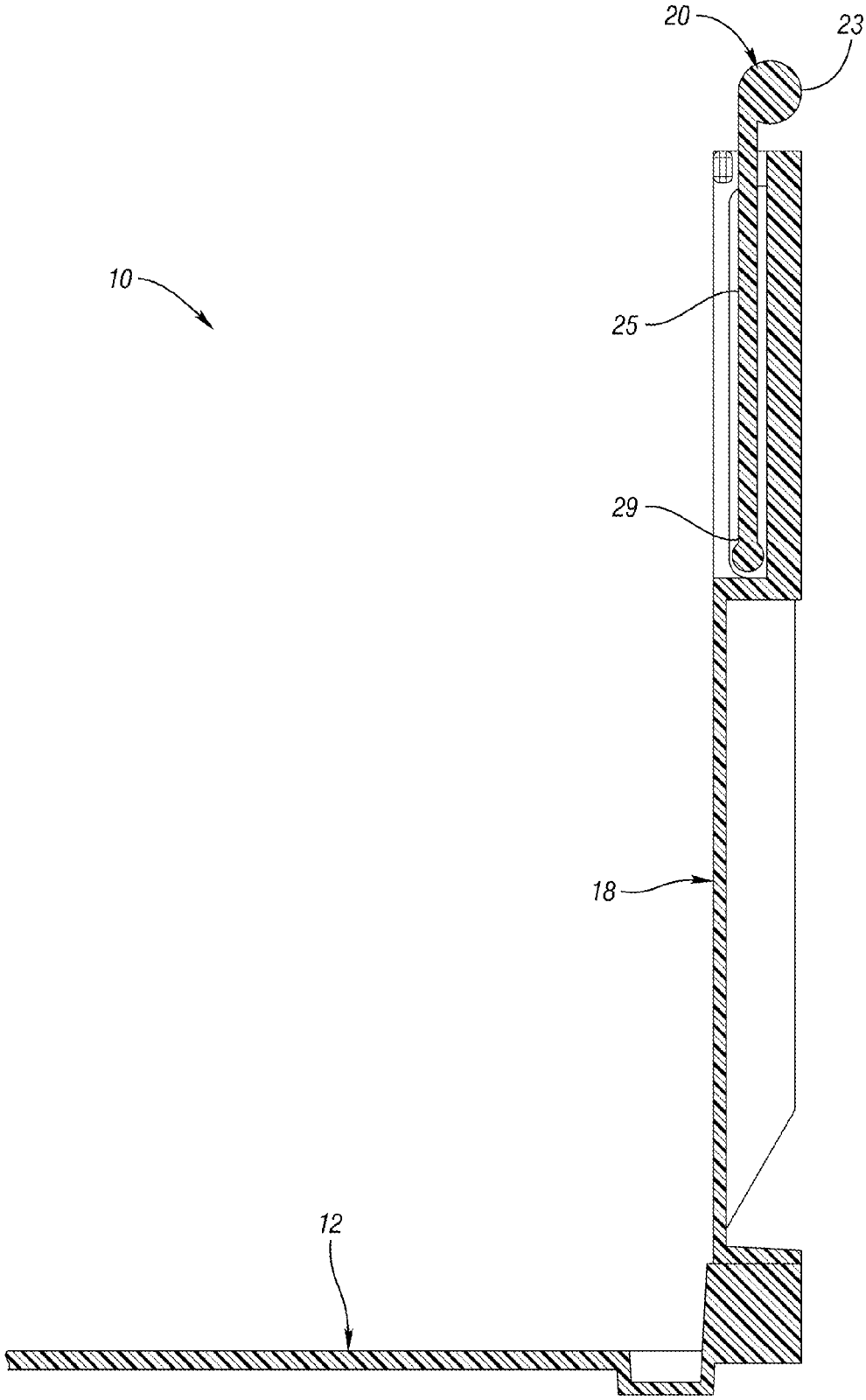
FIG. 11 is a partial sectional view taken along lines 11-11 of FIG. 10.

The support 20 is then pressed downwardly, causing the arm 25 to be inserted into the channel 70 in the end wall 18 until the shoulder 31 of the arm 25 abuts the upper edge of the end wall 18 as shown in FIG. 10. In this position, substantially all of the support 20, more particularly, substantially all of the arm 25, is retracted into the end wall 18, as shown in FIG. 11. The container 10 can be used in this configuration to store and transport goods when the support 20 is not needed to support the other container 100 (FIG. 2).

If the user wants to collapse the container 10 again, the end wall 18 can be pivoted downwardly from the position shown in FIG. 10. As the end wall 18 is pivoted downwardly, the end 21 of the support 20 automatically locates in the channel 24 as shown in FIG. 7 until the end wall 18 is collapsed onto the base 12 as shown in FIG. 5.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. For example, in any of the occurrences above, the hinge members and hinge pins could be reversed and formed on opposite parts.

What is claimed is:

1. A container comprising:

a base;

a first wall pivotably mounted to the base;

a second wall pivotably mounted to the base and having a channel formed on an interior thereof; and a support mounted to the first wall, wherein the support is pivotable and slidable relative to the first wall, the support movable relative to the first wall between a support position in which the support extends into a mouth of the container and a retracted position, the support engaging the channel on the second wall such that the support is moved by the channel from the retracted position toward the support position upon pivoting of the first wall toward an upright position.

2. The container of claim 1 wherein the support is generally parallel to the first wall when the support is in the retracted position and the support is generally perpendicular to the first wall when the support is in the support position.

3. The container of claim 1 wherein the support is supported by the first wall and the second wall in the support position.

4. The container of claim 1 wherein the support is pivotable toward the interior of the container from the retracted position to the support position.

5. A container comprising:

a base;

a first wall pivotably mounted to the base;

a second wall pivotably mounted to the base and having a channel formed on an interior thereof; and a support mounted to the first wall, the support movable relative to the first wall between a support position and a retracted position, the support engaging the channel on the second wall such that the support is moved by the channel from the retracted position toward the support position upon pivoting of the first wall to an upright position, wherein the first wall and the support are collapsible onto the base when the support is in the retracted position.

6. The container of claim 5 wherein the support includes an arm having a first end pivotably and slidably mounted to the first wall and a second end mounted to a support portion, the support portion including an end engaging the channel in the second wall.

7. The container of claim 6 wherein the first end of the arm is slidable relative to the first wall between an upper position and a lower position and wherein the arm is pivotable relative to the first wall in the upper position and in the lower position.

8. A container comprising:

a base;

a first wall pivotably mounted to the base;

a second wall pivotably mounted to the base and having a channel formed on an interior thereof; and a support mounted to the first wall, the support movable relative to the first wall between a support position and a retracted position, the support engaging the channel on the second wall such that the support is moved by the channel from the retracted position toward the support position upon pivoting of the first wall to an upright position, wherein a portion of the support is disposed within the first wall when the support is in the retracted position and the portion of the support is not disposed within the first wall when the support is in the support position.

9. A container comprising:

a base;

a first wall mounted to the base and movable between an upright position and a collapsed position;

a second wall adjacent the first wall and movable between an upright position and a collapsed position on top of the first wall, the second wall including a curved surface on an interior thereof; and a support pivotably and slidably mounted to the first wall, the support having a support portion movable from a first position adjacent the first wall and at least partially within the first wall to a second position spaced inwardly of the container from the first position, wherein the curved surface engages the support and moves the support portion from the first position toward the second position as the first wall is moved from the collapsed position toward the upright position.

10. The container of claim 9 wherein the support and the first wall are movable to the collapsed position when the support is in the first position.

11. A container comprising:

a base;

a first wall mounted to the base and movable between an upright position and a collapsed position;

a second wall adjacent the first wall and movable between an upright position and a collapsed position, the second wall including an abutment surface on an interior thereof; and a support mounted to an upper end portion of the first wall and including a laterally-extending portion engaging the abutment surface upon pivoting of the first wall from the collapsed position to the upright position, the abutment surface moving the support away from the first wall upon movement of the first wall from the collapsed position toward the upright position.

12. The container of claim 11 wherein the support is slidable and pivotable relative to first wall.

13. The container of claim 12 wherein the support is at least partially retractable into the first wall.

14. The container of claim 11 wherein the support is at least partially retractable into the first wall.

15. The container of claim 11 wherein the support is moved into a position restricting a mouth of the container by movement of the first wall from the collapsed position toward the upright position.

* * * * *